United States Patent [19]

Rist

[11] Patent Number: 4,890,346

[45] Date of Patent: Jan. 2, 1990

[54] INFANT CRIB ENCLOSURE

[76] Inventor: Judith Rist, 7855 E. Evans, Scottsdale, Ariz. 85260

[21] Appl. No.: 147,541

[22] Filed: Jan. 25, 1988

[51] Int. Cl.[4] ..... A47D 7/01

[52] U.S. Cl. ..... 5/508; 5/427; 5/512; 5/513; 5/485

[58] Field of Search ..... 5/93 R, 98 R, 99 A, 5/99 C, 48 S, 46 S, 424, 425, 427, 508, 512, 513, 482, 486, 100

[56] References Cited

U.S. PATENT DOCUMENTS

| | | | |
|---|---|---|---|
| 633,112 | 9/1899 | Bartlett | 5/513 |
| 799,390 | 9/1905 | Kuykendall | 5/73 R |
| 949,389 | 2/1910 | Almgren | 5/93 R |
| 1,092,298 | 4/1914 | Schwart | 5/513 |
| 2,025,613 | 12/1935 | Rohan | 5/498 X |
| 2,128,978 | 9/1938 | Akin | 5/93 R |
| 2,471,691 | 5/1949 | Hurst | 5/513 |
| 2,566,790 | 9/1951 | Bloomfield | 5/93 R |
| 2,637,047 | 5/1953 | Zurlolo | 5/498 |
| 2,659,904 | 11/1953 | McGinnis | 5/513 |
| 2,686,922 | 8/1954 | La Vigne | 5/513 X |
| 2,782,839 | 2/1957 | Cole | 297/219 |
| 3,018,492 | 1/1962 | Rosen | 5/93 R |
| 3,137,870 | 6/1964 | Fink | 5/93 R |
| 3,321,779 | 5/1967 | Kaufman et al. | 5/93 R |
| 3,366,294 | 1/1968 | Stephenson | 297/250 U X |
| 3,619,824 | 11/1971 | Doyle | 5/93 R |
| 3,619,825 | 11/1971 | Taub et al. | 5/94 |
| 3,742,530 | 7/1973 | Clark | 5/780 X |
| 3,877,090 | 4/1975 | Schutz | 5/93 R |
| 4,178,926 | 12/1979 | Cohn | 5/513 |
| 4,232,415 | 11/1980 | Webber | 5/512 |
| 4,383,713 | 5/1983 | Roston | 297/219 |
| 4,434,513 | 3/1984 | Welch | 5/425 X |
| 4,648,142 | 3/1987 | Bruning | 5/424 |
| 4,670,923 | 6/1987 | Gabriel et al. | 5/100 |

FOREIGN PATENT DOCUMENTS

| | | | |
|---|---|---|---|
| 7802967 | 9/1979 | Netherlands | 5/93 R |
| 160052 | 3/1921 | United Kingdom | 5/427 |
| 795742 | 5/1958 | United Kingdom | 5/427 |
| 810258 | 3/1959 | United Kingdom | 5/513 |
| 2113987 | 8/1983 | United Kingdom | 5/513 |

OTHER PUBLICATIONS

Dec. 1987, *Small World* Magazine advertisement, p. 61, Rock-A-Bye Baby, Inc. (1975).

*Primary Examiner*—Gary L. Smith
*Assistant Examiner*—Eric K. Nicholson
*Attorney, Agent, or Firm*—Gregory J. Nelson

[57] ABSTRACT

An infant enclosure for use with a conventional baby crib which includes a sheet and a soft bumper which is detachably securable to the sheet to extend across the crib to establish a smaller enclosure within the crib for receiving small children such as newborn infants.

12 Claims, 1 Drawing Sheet

INFANT CRIB ENCLOSURE

The present invention relates to an infant accessory and more particularly to an accessory for use with a conventional baby crib to provide an enclosure for an infant.

Very young infants often exhibit uncontrolled movements when asleep and when infants are awake they often will roll and move about. Unless confined, such movements may possibly cause injury to the child. For this reason, infants are often placed in cradles and other types of enclosures to protect against the effects of sudden movement as by rolling over and by moving when lying in a bed. For example, U.S. Pat. No. 2,782,839 shows a child's chair pad which provides padding for the back or rear of the torso as well as for the waist of the infant. Similarly, U.S. Pat. No. 3,366,294 discloses a carrier for infants which includes a flexible sheet of cloth or plastic having a shorter portion and a longer portion the edges of which are provided with padding. Each portion of the flexible sheet is arcuate. The back of the infant is positioned against the longer portion of the flexible sheet with the neck or back in contact with the end of the padding on the longer portion of the sheet. The infant sits on the shorter portion and straps secure the child in place.

U.S. Pat. No. 4,434,513 shows an infant head device which has a roll that extends around the upper end and along the side of the infant's back. A panel continues beyond the roll and has a flap on which the infant sits. The patentee suggests the device may be placed on a bed, couch or other surface on which the infant is to be placed or in a car seat or other type of seat such as a carrier or stroller.

A somewhat similar support apparatus for infants is shown in U.S. Pat. No. 4,383,713 which discloses an orthopedic support apparatus for infants which has a sheet member of fabric and a pillow removably positioned to the top edge of the sheet. The pillow is configured to accomodate the neck of the infant. Also included are lateral support members located at the side of the infant. The sheet also is provided with strap members to allow the unit to be placed in a stroller, infant chair or other device.

As mentioned above, there are various types of infant enclosures which can be found in the prior art and generally all require placement in a cradle, infant seat or some other device. Generally with small infants, parents and attendants prefer to contain the small child within a protected enclosure which more closely corresponds to the size of the infant.

The present invention provides an infant enclosure which is adapted for use with a conventional crib. Unlike the enclosures mentioned above, the use of an auxiliary infant seat, cradle or other type of support is not required. With the present invention, the parents or attendants can utilize a standard crib which is generally available in most nurseries. Parents and child attendants prefer to place the child in an enclosure smaller than the standard size crib and for that reason resort to auxiliary devices as mentioned above. In some cases, infants of an age from a few weeks to eighteen months or two years are placed in cribs with towels or blankets around them to provide a smaller, padded enclosure.

With the present invention, the necessity for auxiliary cradles and infant seats to contain the child is eliminated as the full size standard crib can be adapted for use by the newborn infant. As the infant grows, the enclosure of the present invention is removed and the child can then utilize the entire crib area. The enclosure of the present invention is intended for use with a standard size crib and comprises a planar sheet section of cotton or similar fabric which has a contoured end conforming to the shape of the crib mattress and is fitted to this end. The planar sheet section extends for a part of the length of the mattress and is provided with a transversely extending fastener section which preferably is of hook and loop fastener material such as that sold under the mark Velcro. A bumper having an outer covering of fabric is filled with a resilient, compressible material such as foam, cotton, or fiberfill. The bumper has a length generally corresponding to the width of the crib and height that corresponds generally to the distance from the mattress to the top of the crib rails when locked in the "up" position. The bumper is provided with ties so that it may be secured in a vertical position between the opposite side rails of the crib and is provided with a strip of mating fastener material so that the bottom transverse edge of the bumper may be secured substantially along its length to the planar sheet section on the mattress. Since the crib normally incorporates bumpers or padding extending around the interior periphery of the crib ends and rails, the enclosure of the present invention serves to subdivide the crib interior into a smaller, environmental enclosure for the infant child.

In other embodiments of the present invention, the planar sheet covering on the crib mattress comprises a full sheet extending over the entire surface of the mattress. The bumper also may be provided with a pocket for receiving a device such as a heartbeat device or music box for the contentment of the infant.

Figure 1:
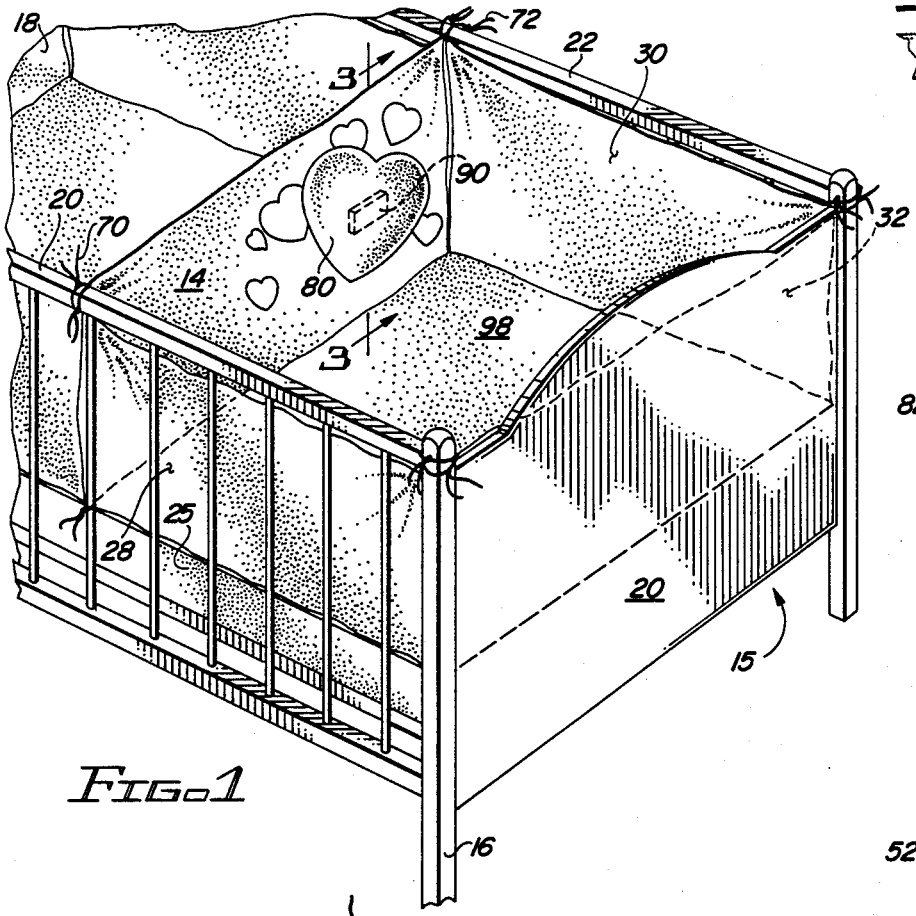
FIG. 1 is a top perspective view of an infant enclosure according to the invention shown in conjunction with a standard crib.

The crib infant enclosure of the present invention is shown in FIGS. 1 to 4 and is generally designated by the numeral 10 and includes a planar sheet portion 12 and a transverse padded bumper 14. The enclosure 10 is to be used in conjunction with a conventional baby crib 15 which is generally rectangular having legs 16 at the corners and opposite ends 18 and 20. Side rails 20 and 22 extend between ends 18 and 20 and conventionally one or both of the side rails 20 and 22 are movable between a lowered position and an up-locked position. The lower position of the rails permits easy access to the crib mattress 25. With the rails 20 and 22 in the up position as shown in FIG. 1, the rails generally extend a substantial distance above the planar surface of the mattress to retain the child within the crib. It is also conventional to provide padded members 28 and 30 at the opposite side rails 20 and 22 of the crib and padded member 32 at the crib end to protect the baby from the hard surfaces of the crib. These padded members may be fabric or other material such as vinyl, suitably filled with resilient padding of polyester, fiberfill, cotton or the like.

Figure 2:
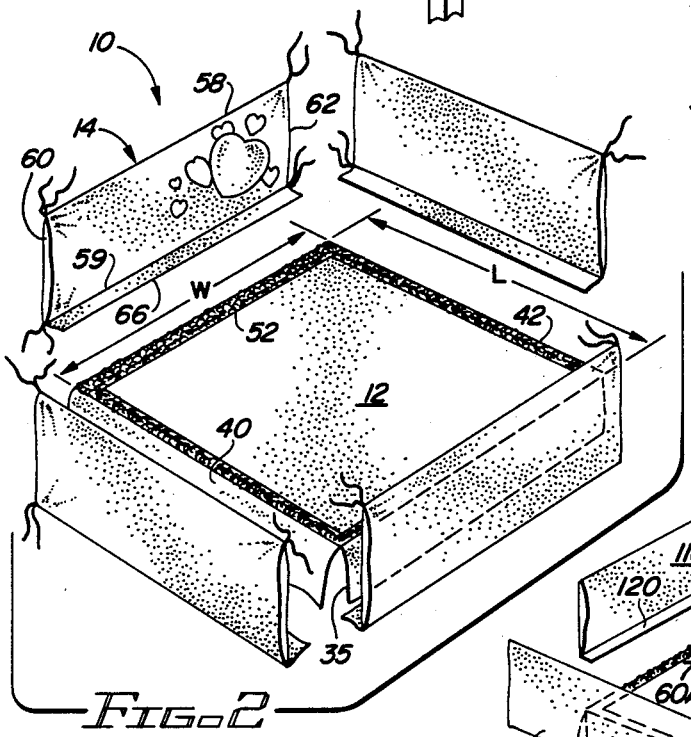
FIG. 2 is a perspective view of the enclosure.

As seen in FIGS. 1 and 2, the planar sheet member 12 is preferably a fabric such as cotton or cotton polyester having a width W and a length L. The width W generally corresponds to the width of the crib mattress. The end of the planar member 12 is preferably formed having contoured fitting section 35 which engages the end of the mattress to secure the planar member 12 in place. The length L of the planar member 12 may be any convenient length, but preferably proximates about one-half the overall length of the crib. The opposite edges of the planar sheet member 12 are preferably similarly formed having contoured edges 40 and 42 which correspond to the thickness of the mattress and engage the mattress 25 to maintain section 12 in a planar position on the upper surface of the mattress.

The distal transverse edge of planar sheet member 12 defines a fastener section 52. Fastener section 52 may include a plurality of snaps, buttons, but preferably as shown is a strip of one portion of loop and hook fastener material such as that sold under the trademark Velcro. Fastener section 52 extends across the entire width of the planar sheet 12 so that when the bumper member 14 is attached as will be described hereinafter, a continuous line of attachment exists so that the infant cannot crawl or slide beneath the bumper 14 or so that an arm or leg of the child cannot be caught between the planar section 12 and the bumper 14.

Figure 3:
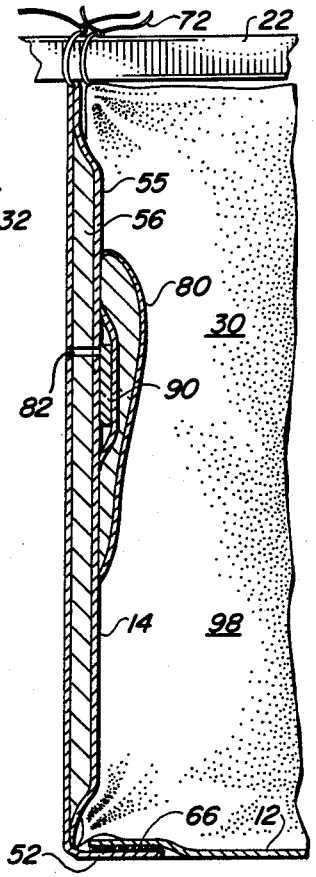
FIG. 3 is a cross-sectional view taken along lines 3—3 of FIG. 1.

As best seen in FIG. 3, bumper 14 consists of an outer fabric casing 55 of cotton, polyester or similar material which is stitched or sewn around its outer edge and may be provided with a decorative fringe or appropriate pattern on the material. The bumper 14 is filled with a suitable soft resilient material 56 such as cotton, foam or fiberfill, preferably having a thickness of one inch or more. The bumper panel is generally rectangular having opposite longitudinal sides 58 and 59 and vertical ends 60 and 62. The bumper may be imprinted with a suitable pattern and may include a decorative fringe 65. A section of fastener material 66 extends substantially along the underside of bottom edge 59. Fastener section is cooperative with the transverse fastener section 52 on the sheet 12 so that the bumper and edge of the sheet section may be detachably secured across the entire width of the crib. Preferably, the fastener section on the bumper comprises one portion of a loop and hook fastener of the type sold under the trademark Velcro.

A pair of ties 70 and 72 are provided at opposite vertical edges of the bumper so that the bumper 14 may be secured in a vertical position transverse of the crib by tying the upper and lower edges to the opposite crib rails.

When installed as indicated above, bumper 14 compartmentalizes or subdivides the crib so that a smaller enclosure 98, more consistent with the size of a small child or infant, is provided within the confines of the crib. The bumper 14 is padded for the comfort of the infant. The bumper taken along with the conventional padding members 28, 30 and 32 existing within the interior of the crib provides a safe, secure and snug enclosure for the infant. To further add to the feeling of a secure environment, a pocket 80 is stitched to the interior face of the bumper. The pocket preferably is in the shape of a heart, animal or other object normally associated with the nursery. The area of the bumper immediately adjacent the pocket defines an aperture 82 so that the parent or attendant can insert and operate an audio device 90 from the opposite side of the bumper by reaching through the aperture. The audio device may be a music box or preferably is a device that simulates a heartbeat to give the child a feeling of security. Such devices are known and one such device is sold under the designation Heartbeat by Rockabye.

Figure 4:
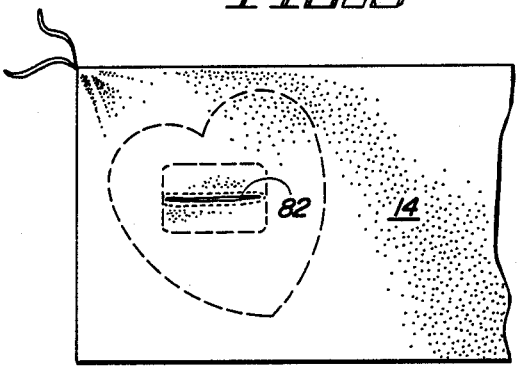
FIG. 4 is a rear view of the bumper showing the pocket for reception, of an audio device.

FIGS. 3 and 4 show an alternate embodiment of the present invention which is generally designated by the numeral 100. In this embodiment, the same numbers are used to identify the same or similar elements as were used with reference to FIGS. 1 and 2 with a letter A being appended for differentiation. In this embodiment, the bumper 14A is again shown extending transverse of the conventional crib mattress 25A. A sheet 12A is generally planar and covers the conventional mattress in the crib extending, in the case of this embodiment, the entire length of the crib. The sheet 12A is preferably contoured along its opposite edges and sides to snugly fit the mattress. A fastener section 52A extends transversely of the sheet at an intermediate location for detachably securing the mating fastener portion 66A on the padded bumper 14A. The bumper 14A has opposite top and bottom edges 58A, 59A and opposite vertical sides 60A, 62A and is fabricated from a suitable fabric material which form a casing and which is a suitable soft resilient material. Ties 70A, 72A are provided at opposite side edges to secure the bumper 14A in place in a transverse position across the crib.

Figure 5:
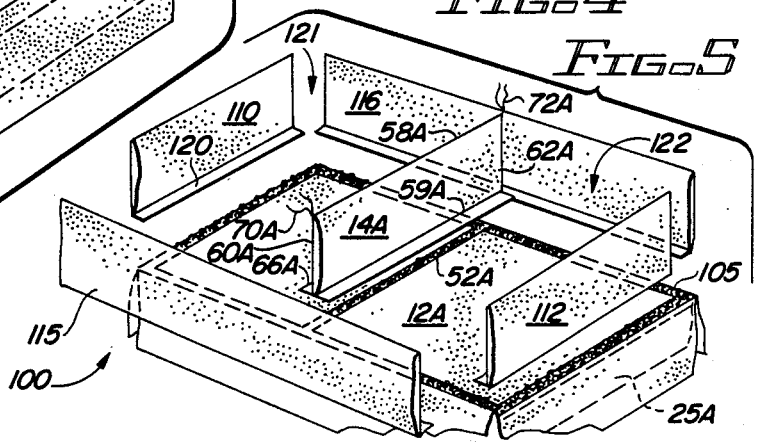
FIG. 5 is an exploded, perspective view showing an alternate embodiment of the invention.

The peripheral edges of the sheet section 12A adjacent the ends and sides of the crib are also provided with a fastener section 105 which may be one element of a cooperative loop and hook fastener such as Velcro. Bumpers 110 and 112 at opposite ends of the crib and padded bumpers 115 and 116 at opposite sides of the crib are constructed similar to bumper 14A having a mating fastener section 120 along their respective lower edges. Thus, with the embodiment shown in FIG. 5, two separate compartments 121, 122 are formed, either of which may be used to confine the infant. Further, each enclosure is provided with peripherally extending padding which is substantially continuously secured to the sheet section 12A along the separable fastener sections. In this way, there are no openings at the intersection of the sheet and the bumpers through which a child may inadvertently catch a limb or other portion of the child's body. As has been described with reference to FIGS. 1 to 4, a suitable pocket may be provided in the transverse bumper for reception of an environmentally soothing audio device.

Although it has been described, the preferred embodiment of the enclosure of the present invention, it is of course understood that alternate embodiments can be employed without departing from the spirit and scope of the appended claims. These and other features are deemed to be within the scope and breadth of this invention as encompassed by the following claims.

I claim:

1. An infant enclosure for use with a crib having opposite ends and opposite sides defining an area supporting a bed surface therein having a width and length, said enclosure comprising:

(a) a substantially planar panel having a width at least corresponding to the width of the bed surface and having a predetermined length extending along the length of said bed surface, said panel being provided with a first fastener section extending transversely and substantially continuously across the width of said panel; and (b) a bumper member generally perpendicular to said panel having a bottom edge, said bumper member having a casing containing a resilient material, said bumper member having a second fastener section detachably securable to said first fastener section, said second fastener section extending substantially continuously along said bottom edge whereby said bumper member is detachably securable to said panel to divide the panel into two infant-receiving compartments.

2. The infant enclosure of claim 1 wherein said bumper member has opposite generally vertical sides, said sides being provided with fastener means at opposite ends of said bumper detachably securable to the sides of said crib.

3. The infant enclosure of claim 1 wherein said panel extends a length approximately corresponding to one-half the length of said bed surface terminating at a transverse edge and wherein said first fastener section extends adjacent the transverse edge of said panel.

4. The infant enclosure of claim 1 wherein said panel is substantially co-extensive with said bed surface and wherein said first fastener section extends transversely of said panel at a location approximately corresponding to the center of said bed surface.

5. The infant enclosure of claim 1 wherein said panel is provided with a contoured surface adapted to snugly engage the bed surface.

6. The infant enclosure of claims 3 or 4 wherein said panel and casing are formed of a fabric material.

7. The infant enclosure of claim 6 wherein said bumper member is provided with decorative indicia.

8. The infant enclosure of claim 1 wherein said bumper member further includes a pocket integrally formed therein.

9. The infant enclosure of claim 8 wherein said casing defines an aperture immediately adjacent said pocket for access thereto.

10. The infant enclosure of claim 4 further including a third fastener section extending at least along one longitudinal edge of the said panel and at opposite ends thereof and further including resilient peripherally extending bumper members having a fourth fastener section therein extending along a lower edge thereof detachably securable about at least a portion of the periphery of said panel at said third fastener section.

11. The infant enclosure of claim 1 wherein said first and second fastener sections comprise mating loop and hook fasteners.

12. The infant enclosure of claim 10 wherein said first, second, third and fourth fastener sections comprise mating loop and hook fasteners.

* * * * *